US006629907B2

(12) United States Patent
Popp

(10) Patent No.: US 6,629,907 B2
(45) **Date of Patent: *Oct. 7, 2003**

(54) VERTICAL CLIMBING WALL

(76) Inventor: Richard R. Popp, 110 Woodlane Dr., Cedarville, IL (US) 61013

( * ) Notice: Subject to any disclaimer, the term of this patent is extended or adjusted under 35 U.S.C. 154(b) by 0 days.

This patent is subject to a terminal disclaimer.

(21) Appl. No.: 10/102,396

(22) Filed: Mar. 19, 2002

(65) Prior Publication Data

US 2002/0098949 A1 Jul. 25, 2002

Related U.S. Application Data

(63) Continuation of application No. 09/289,040, filed on Apr. 9, 1999.

(51) Int. Cl.[7] ..... A63B 9/00
(52) U.S. Cl. ..... 482/35
(58) Field of Search ..... 482/35–38

(56) References Cited

U.S. PATENT DOCUMENTS

| | | | | | |
|---|---|---|---|---|---|
| 3,949,985 | A | * | 4/1976 | Stampfli | 272/60 |
| 5,125,877 | A | | 6/1992 | Brewer | |
| 5,137,271 | A | | 8/1992 | Frankel | |
| 5,177,926 | A | * | 1/1993 | Frankel | 52/655.1 |
| 5,254,058 | A | | 10/1993 | Savigny | |
| D363,522 | S | | 10/1995 | Erlick | |
| D374,902 | S | | 10/1996 | Bookstaver et al. | |
| 5,634,687 | A | | 6/1997 | Gamble | |
| 5,732,954 | A | | 3/1998 | Strickler et al. | |
| 5,816,980 | A | * | 10/1998 | Myszka et al. | 482/35 |
| 6,402,663 | B1 | * | 6/2002 | Popp | 482/35 |

OTHER PUBLICATIONS

"Inclined Rock Climber", #757–2, Miracle Recreation Equipment Company, 12/98, p. 69.
"Building A Climbing Wall", Metolius Mountain Products, 3/97.

* cited by examiner

*Primary Examiner*—Nicholas D. Lucchesi
*Assistant Examiner*—L Amerson

(57) ABSTRACT

The present invention relates to a climbing wall for simulating outdoor rock climbing activity. The climbing wall includes a front surface, a rear surface and an intermediate portion reaching between the front surface and the rear surface. The intermediate portion defines one or more openings which extend through the climbing wall. The openings are located in positions that allow a child to travel safely around on the climbing wall. The intermediate portion also includes a grip projecting outward from the front surface and preferably the rear surface of the climbing wall. The grips are designed to allow a child to maneuver safely around the climbing wall.

18 Claims, 2 Drawing Sheets

VERTICAL CLIMBING WALL

CROSS-REFERENCE TO RELATED APPLICATIONS

This application is a continuation of application Ser. No. 09/289,040 which was filed Apr. 9, 1999.

BACKGROUND OF THE INVENTION

The invention relates to a climbing wall and a playstation incorporating the climbing wall, and particularly, to a climbing wall and a playstation incorporating the climbing wall that allows children to safely simulate rock climbing activity.

Climbing walls are normally used by experienced rock climbers to simulate outdoor rock climbing activity. The climbing walls provide rock climbing enthusiasts with the opportunity to simulate an outdoor climbing activity at an easily accessible location (e.g., an exercise facility or at home).

There are two conventional types of climbing walls that are used to simulate rock climbing activity. The first type of climbing wall includes a substantially vertical climbing surface that has a rock-like texture (see, e.g., U.S. Pat. No. 5,254,058). The shape, or texture, of the climbing wall determines the level of difficulty associated with maneuvering around on this type of climbing wall. The second type of climbing wall includes rock-like hand/foot holds that are attached to a normal (i.e., substantially smooth) wall (see, e.g., U.S. Pat. No. 5,125,877). There are two ways to adjust the level of difficulty associated with maneuvering about this type of climbing wall. First, the location of the hand/foot holds on the wall vary according to the level of skill of a particular climber. Second, the shape of the individual hand/foot holds can be modified in order to make them easier, or more difficult, to grasp.

There are also climbing walls or structures that are specifically designed for climbing activity by children (see, e.g., U.S. Pat. Nos. 5,816,980, 5,634,687, 5,177,926 and D374,902). Conventional children's climbing walls typically include a variety of simply shaped geometric shapes and openings. The shapes and openings are arranged in a variety of configurations that allow children to maneuver around the climbing wall or structure. One of the problems associated with prior art climbing walls/structures is that they provide an inadequate grip area for children. Due to the limited physical abilities of children (i.e., limited strength and small hand size), there is a safety risk associated with one or more children maneuvering around on existing climbing walls. Another problem associate with existing children's climbing walls/structures is that they provide a poor simulation of rock climbing activity.

SUMMARY OF THE INVENTION

Accordingly, the invention provides a climbing wall for simulating outdoor rock climbing activity. The climbing wall includes grips designed to allow a child to maneuver safely around on the climbing wall. The climbing wall also includes a front surface, a rear surface and at least one intermediate portion reaching between the front surface and the rear surface to define one or more openings which extend through the climbing wall. The openings are located in positions that allow a child to travel safely around on the climbing wall. The intermediate portion also includes a grip projecting outward from the front surface. In a preferred form of the invention, the grip also projects outward from the rear surface of the climbing wall.

The grips also reach around the circumference of one or more openings in the climbing wall, although the grips could reach around one or more portions of the circumferences of one or more openings.

In another form of the invention, the front and rear surfaces of the climbing wall are textured to have a rock-like appearance, and each of the openings has an irregular shape in order to facilitate the simulation of outdoor rock climbing activity.

The invention also provides a playstation including a frame. The climbing wall is attached to a support member on the frame.

It is an advantage of the invention to provide a playstation and a climbing wall for the playstation, the climbing wall having a simulated rock-like appearance.

It is another advantage of the invention to provide a climbing wall for children that includes grips which allow a child to maneuver safely around the climbing wall.

It is yet another advantage of the invention to provide a climbing wall for children that allows children to climb both sides of the wall.

It is still another advantage of the invention to provide a children's climbing wall that is readily attached to a playstation as well as other similar climbing walls for use as part of a climbing network.

Other features and advantages of the invention are set forth in the following drawings, detailed description and claims.

Figure 1:
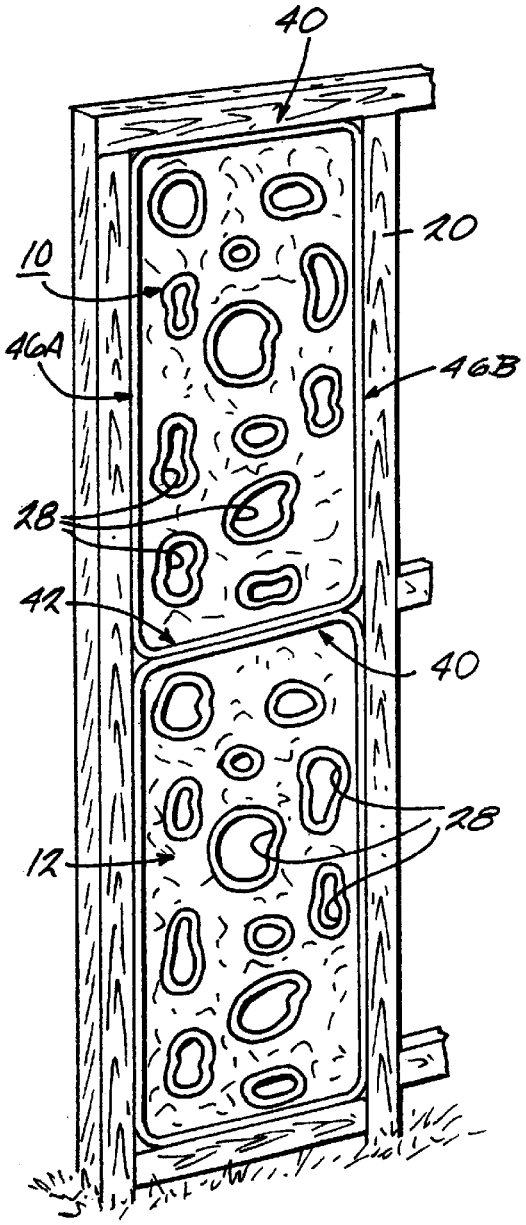
FIG. 1 is a perspective view of a pair of climbing walls mounted one on top of the other and attached to a support structure of a playstation.

Before one embodiment of the invention is explained in detail, it is to be understood that the invention is not limited in its application to the details of the construction and the arrangements of the components set forth in the following description or illustrated in the drawings. The invention is capable of other embodiments and of being practiced or being carried out in various ways. Also, it has to be understood that the phraseology and terminology used herein is for the purpose of description and should not be regarded as limiting.

DETAILED DESCRIPTION OF THE PREFERRED EMBODIMENTS

FIG. 1 illustrates the climbing wall 10 of the invention. The climbing wall 10 is shown mounted on top of a second climbing wall 12. Both the climbing wall 10 and the climbing wall 12 are attached to a support structure 20. The climbing wall 10 is identical to the climbing wall 12. Accordingly, only the climbing wall 10 will be described in detail. Like parts are identified using like reference numerals. The support structure 20 is typically part of a play station, or some other structure that is sturdy enough to secure one or more climbing walls.

Figure 2:
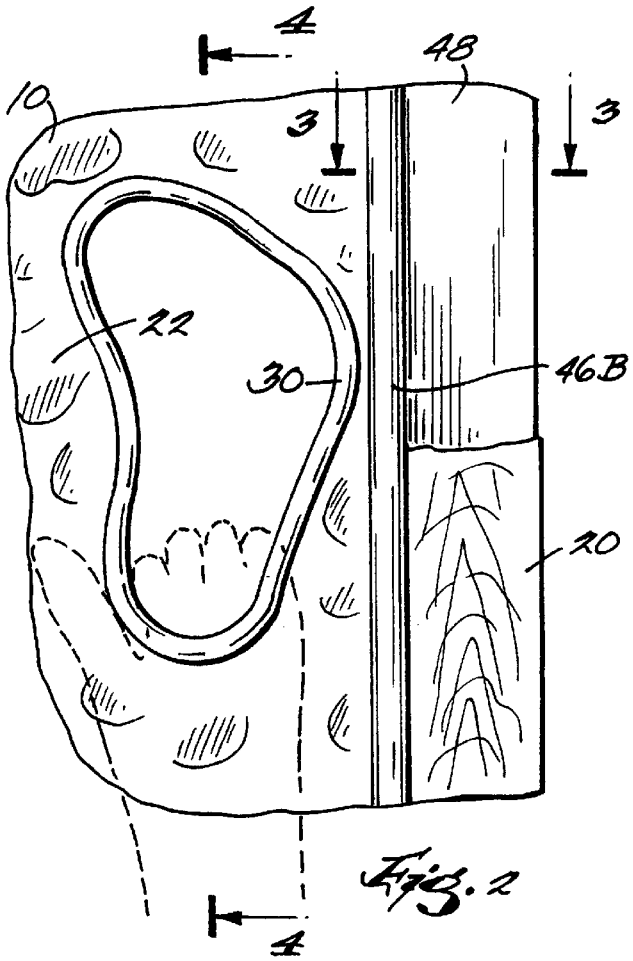
FIG. 2 is an enlarged plan view of a portion of one of the climbing walls of FIG. 1.
Figure 4:
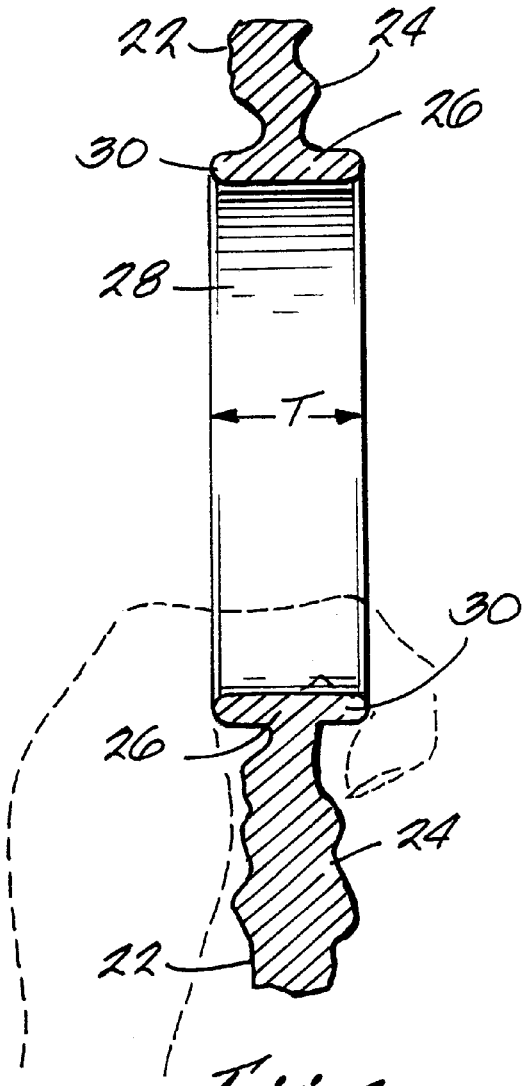
FIG. 4 is a section view of the climbing wall of FIG. 2 taken along line 4—4.

As shown most clearly in FIGS. 2 and 4, the climbing wall of the present invention comprises a front surface 22, a rear surface 24 and. an intermediate portion 26 extending between the front surface 22 and the rear surface 24. The intermediate portion 26 defines a plurality of openings 28 that extend through the climbing wall 10. In the preferred embodiment, the openings 28 are each a different size and shape, are irregularly shaped and are irregularly spaced. In other embodiments (not shown), the openings 28 may be the same size or shape, may be symmetrically shaped and may be regularly spaced in relation to each other. The intermediate portion 26 further includes a grip 30 projecting outward from the front surface 22 and preferably projecting outward from the rear surface 24.

As shown in FIG. 1, the climbing wall 10 also includes a top side 40 and a bottom side 42. The climbing wall 10 is designed so that, when properly mounted in the playstation, the top side 40 and the bottom side 42 mate with or abut snugly against the bottom side 42 or top side 40, respectively, of the adjacent climbing wall 10.

The climbing wall also includes lateral sides 46A, 46B. The lateral sides include a flange 48 (see FIGS. 2 and 3) for mounting the climbing wall 10 to the support structure 20.

Figure 3:
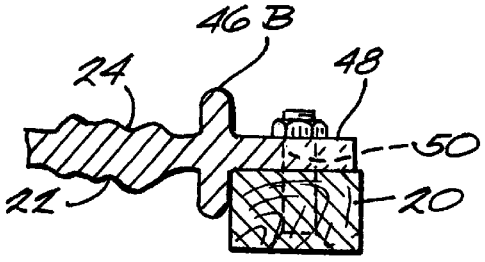
FIG. 3 is a section view of the climbing wall of FIG. 2 taken along line 3—3.

As shown in FIG. 3, the flange 48 includes a plurality of through-bores 50 (only one is shown) spaced along the flange. While other means of connecting the flange 48 to the support structure 20 are suitable, in the preferred embodiment, a wood screw or bolt extends through the bore 50 and into the support structure 20.

Figure 5:
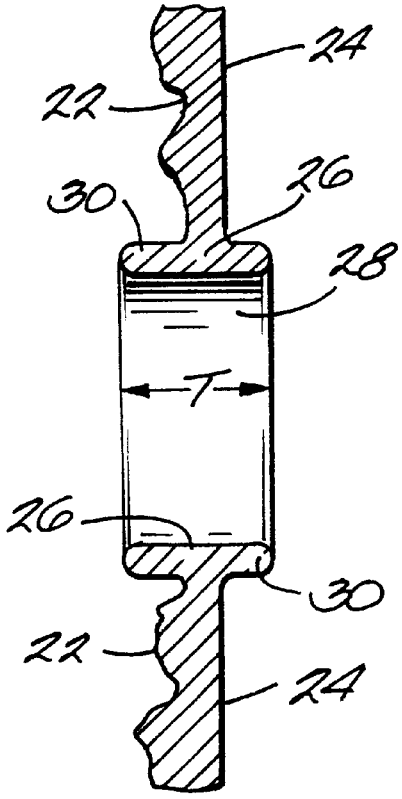
FIG. 5 is a section view of a portion of a climbing wall of the present invention where only the front surface is textured to have a rock-like appearance.

As shown most clearly in FIGS. 2–4, the front surface 22 is preferably textured to have rock-like appearance, although the rear surface 24 could also be textured (a comparison is shown in FIGS. 4 and 5). The rock-like appearance of the front surface 22 and the rear surface 24 facilitate the impression that children using the climbing wall are actually rock climbing. The simulation of outdoor rock climbing activity is also facilitated by further including additional irregularly-shaped openings (see FIG. 1). The openings 28 are located on the climbing wall in such a manner as to allow children to safely maneuver around on the climbing wall 10.

As shown in FIGS. 3–5, the grip 30 preferably extends outward from both the front surface 22 and the rear surface 24. Moreover, and as clearly shown in FIG. 2, the grip 30 extends continuously around the entire opening 28. In other embodiments (not shown) the grip 30 may only extend around portions of the opening 28. The grip also includes a thickness (shown as dimension "T" in FIGS. 4 and 5), where the largest possible dimension of the thickness is less than 1.6 inches. This dimension corresponds to specification ASTM designation F 1148-97a.

Various features and advantages of the present invention are set forth in the following claims.

What is claimed is:

1. A climbing wall comprising:

first and second oppositely facing surfaces, and an intermediate portion extending between the first and second surfaces and defining an opening extending through the climbing wall;

wherein at least one of the first surface, the second surface, and the intermediate portion defines a grip on the climbing wall adjacent the opening that facilitates grasping and holding onto the climbing wall; and wherein at least one of the first and second surfaces adjacent the aperture is non-planar.

2. The climbing wall of claim 1, wherein the opening has an irregular shape.

3. The climbing wall of claim 1, wherein the first surface is textured to have a simulated rock appearance.

4. The climbing wall of claim 1, wherein the first surface is a front surface and the second surface is a rear surface.

5. A climbing wall comprising:

a first surface;

a second surface;

an opening extending through the climbing wall between the first and second surfaces; and a grip adjacent the opening such that a user can reach through the opening to grasp the grip when climbing on the wall; and wherein at least one of the first and second surfaces adjacent the aperture is non-planar.

6. The climbing wall of claim 5, wherein the opening has an irregular shape.

7. The climbing wall of claim 5, wherein the first surface is textured to have a simulated rock appearance.

8. The climbing wall of claim 5, wherein the first surface is a front surface and the second is a rear surface.

9. A climbing wall comprising:

a body having an uneven and irregularly-shaped first surface and an oppositely facing second surface; and a plurality of irregularly shaped apertures defined by portions of the body, each portion of the body having first and second sides, the apertures having a size sufficient to receive the fingers of a human hand therethrough, the first and second sides of each portion of the body defining a band grip for a user climbing the wall;

wherein at least one of the first and second sides adjacent the aperture is non-planar.

10. The climbing wall of claim 9, wherein the first surface is textured to have a simulated rock appearance.

11. The climbing wall of claim 9, wherein the first surface is a front surface and the second surface is a rear surface.

12. The climbing wall of claim 9, wherein the body defines a panel configured to be used in conjunction with a playstation.

13. A climbing wall panel comprising:

a panel body; and a plurality of apertures in the panel body, each aperture having a size sufficient to receive the fingers of a human hand therethrough and being surrounded by portions of the panel body having front and rear surfaces on opposite sides of the panel body, the rear surfaces of the portions of the panel body adjacent to the apertures shaped to define grips about which the fingers of a user can grip;

wherein at least one of the front and rear surfaces adjacent the aperture is non-planar.

14. The climbing wall panel of claim 13, wherein the apertures have an irregular shape.

15. The climbing wall panel of claim 13, wherein the front surface is textured to have a simulated rock appearance.

16. A climbing wail comprising:

a front side having a front surface;

a rear side having a rear surface;

an aperture extending between the front and rear surfaces, the aperture sufficiently large to receive fingers of a hand therethrough from the front side of the climbing wall to the rear side of the climbing wail; and an intermediate surface between the front and rear surfaces, the intermediate surface and at least one of the front and rear surfaces at least partially defining the aperture, at least one of the rear surface and the intermediate surface shaped to facilitate gripping the climbing wall;

wherein at least one of the front and rear surfaces adjacent the aperture is non-planar.

17. The climbing wall of claim 16, wherein the aperture has an irregular shape.

18. The climbing wall of claim 16, wherein the front surface is textured to have a simulated rock appearance.

* * * * *

UNITED STATES PATENT AND TRADEMARK OFFICE

CERTIFICATE OF CORRECTION

PATENT NO. : 6,629,907 B2
DATED : October 7, 2003
INVENTOR(S) : Richard R. Popp

It is certified that error appears in the above-identified patent and that said Letters Patent is hereby corrected as shown below:

Column 4,
Line 30, change “band” to -- hand --
Line 58, change “wail” to -- wall --

Signed and Sealed this

Twenty-fifth Day of November, 2003

JAMES E. ROGAN
*Director of the United States Patent and Trademark Office*